US007413517B2

(12) United States Patent
Butler, Jr. et al.

(10) Patent No.: US 7,413,517 B2
(45) Date of Patent: Aug. 19, 2008

(54) RECONFIGURABLE GOLF CLUB AND METHOD

(76) Inventors: Joseph H. Butler, Jr., 643 Brochard Blvd., Knoxville, TN (US) 37922; Michael J. Twigg, 8715 Brucewood La., Knoxville, TN (US) 37923

( * ) Notice: Subject to any disclaimer, the term of this patent is extended or adjusted under 35 U.S.C. 154(b) by 222 days.

(21) Appl. No.: 11/042,404

(22) Filed: Jan. 25, 2005

(65) Prior Publication Data

US 2006/0166757 A1 Jul. 27, 2006

(51) Int. Cl.
*A63B 53/04* (2006.01)
*A63B 53/06* (2006.01)

(52) U.S. Cl. ..... 473/288; 473/330; 473/334; 473/342; 473/349

(58) Field of Classification Search ..... 473/324–350, 473/244–288, 131, 151–156
See application file for complete search history.

(56) References Cited

U.S. PATENT DOCUMENTS

| | | | | | |
|---|---|---|---|---|---|
| 1,253,700 | A | * | 1/1918 | McLaughlin | 473/288 |
| 3,084,940 | A | * | 4/1963 | Cissel | 473/332 |
| 3,190,651 | A | * | 6/1965 | Thomas | 473/245 |
| 3,368,812 | A | * | 2/1968 | Baldwin, Sr. | 473/330 |
| 3,863,932 | A | * | 2/1975 | Lezatte | 473/342 |
| 4,121,832 | A | | 10/1978 | Ebbing | |
| 4,618,149 | A | | 10/1986 | Maxel | |
| 4,804,188 | A | * | 2/1989 | McKee et al. | 473/342 |
| 4,864,854 | A | | 9/1989 | vanLeemput | |
| 4,884,808 | A | * | 12/1989 | Retzer | 473/288 |
| 5,141,231 | A | | 8/1992 | Cox | |
| 5,299,807 | A | * | 4/1994 | Hutin | 473/329 |
| 5,431,396 | A | | 7/1995 | Shieh | |
| 5,505,453 | A | | 4/1996 | Mack | |
| 5,509,660 | A | * | 4/1996 | Elmer | 473/288 |
| 5,524,331 | A | * | 6/1996 | Pond | 29/527.4 |
| 5,743,813 | A | | 4/1998 | Chen et al. | |
| 5,779,560 | A | | 7/1998 | Buck et al. | |

(Continued)

FOREIGN PATENT DOCUMENTS

JP 6269521 9/1994

OTHER PUBLICATIONS

D.C. Winfield and Teong E. Tan, Optimization of the Clubface Shape of a Gold Driver to Minimize Dispersion of Off-Center Shots, Aug. 2, 1994 Memphis State University, 935 Hiawatha, Memphis, TN.

*Primary Examiner*—Sebastiano Passaniti
(74) *Attorney, Agent, or Firm*—Luedeka, Neely & Graham, P.C.

(57) ABSTRACT

A reconfigurable golf club head and a method for fitting a golf club to a golfer are described. Optimum club head design parameters are determined based on one or more of the following factors: the golfer's swing characteristics, ball flight trajectory tendency information, course and weather conditions, golf ball dynamic flight characteristics and personal preferences. Lookup tables or mathematical algorithms, such as impact and trajectory simulations, may be used. Features of the reconfigurable golf club head include a replaceable face plate to adjust the profile of the club face and a replaceable weight plate to adjust the club head center of gravity and inertia properties. Adjustable characteristics of the club face include the loft angle, bulge radius and roll radius.

19 Claims, 13 Drawing Sheets

U.S. PATENT DOCUMENTS

| | | | | |
|---|---|---|---|---|
| 5,863,257 | A | 1/1999 | Busnardo | |
| 5,911,636 | A | 6/1999 | Schmoll | |
| 6,071,200 | A | 6/2000 | Song | |
| 6,102,813 | A | 8/2000 | Dill | |
| 6,565,448 | B2 | 5/2003 | Cameron et al. | |
| 6,648,774 | B1 | 11/2003 | Lee | |
| 6,669,571 | B1 | 12/2003 | Cameron et al. | |
| 6,669,577 | B1 | 12/2003 | Hocknell et al. | |
| 6,702,692 | B1 | 3/2004 | Smith | |
| 6,719,648 | B1 | 4/2004 | Smith | |
| 7,108,611 | B2 * | 9/2006 | MacIlraith | 473/288 |
| 2002/0019265 | A1 | 2/2002 | Allen | |
| 2003/0008731 | A1 | 1/2003 | Anderson et al. | |
| 2003/0153401 | A1 | 8/2003 | Helmstetter et al. | |
| 2004/0043839 | A1 | 3/2004 | Inoue et al. | |
| 2004/0053704 | A1 * | 3/2004 | Gilbert | 473/290 |
| 2004/0127304 | A1 | 7/2004 | Plank, Jr. | |
| 2004/0204257 | A1 | 10/2004 | Boscha et al. | |

* cited by examiner

RECONFIGURABLE GOLF CLUB AND METHOD

FIELD

This invention relates to the field of adjustable and reconfigurable golf clubs. More particularly, this invention relates to golf club heads for which the club face configuration and center of gravity may be modified by the user.

BACKGROUND

In the sport of golf there is a wide variety of swing patterns exhibited by players. Not only does the style of swing vary from player to player, but the swing pattern of an individual golfer typically varies over time. Such variations are the result of different skill levels and physical capabilities of the golfers, as well as changes induced by growth, aging, physical exercise, weight changes and various environmental changes. It is generally recognized that the skill level of a golfer may be enhanced by fitting the golfer with golf clubs that compensate for the weaknesses and enhance the abilities of the golfer. Consequently, systems have been developed for assisting a golfer in selecting golf clubs that are best suited for his or her abilities. A problem that has generally not been addressed is the variation of swing patterns of an individual golfer over time. Generally the current golf club fitting systems require skilled craftsmanship and specialized tooling to modify a golf club after it has been configured for a specific golfer. What is needed is a golf club method and equipment that can be easily modified as the golfer's abilities and swing characteristics change.

SUMMARY

In the present invention, a method is provided for fitting a golf club to a golfer. The method begins by acquiring swing information related to the manner in which the golfer swings a test golf club. The swing information is entered into a computer which determines optimal club head design parameters based at least in part on the swing information. Using the computer, an optimal club design configuration is then selected based at least in part on the optimal club head design parameters. The optimal club configuration is then enabled, such as by the selection of an optimum combination of a face plate profile and a weight configuration for the golf club head.

In some preferred embodiments, the computer determines the optimal club head design parameters based on swing velocity and approach angle using a lookup table and/or trajectory simulation. Also in preferred embodiments, the computer determines the optimal club head design parameters based at least in part on golf course conditions that affect ball roll distance and on expected weather conditions, such as wind velocity. Other weather parameters that may be taken into account include humidity, air density and viscosity, barometric pressure, and temperature. In some preferred embodiments, the computer determines the optimal club head design parameters based at least in part on dynamic flight characteristics of a golf ball with which the golf club is to be used, such as rotational inertia and lift and drag properties.

In a preferred embodiment, the invention provides an automated method for configuring and providing a golf club using a communication network such as an intranet or the Internet. The method includes providing an interactive purchasing interface that is accessible to a purchaser by way of the communication network. The purchaser is prompted by way of the purchasing interface to provide information related to golf club swing characteristics of a golfer who is to use the golf club. The information related to golf club swing characteristics is received by way of the purchasing interface and an optimum configuration for the golf club is determined based at least in part on the information related to the golfer's swing characteristics. The purchaser is then advised regarding the optimum configuration for the golf club by way of the purchasing interface, and a purchase order is received for the golf club having the optimum configuration.

In another aspect, the invention provides a reconfigurable golf club head. The golf club head includes a club head body having a cavity defined by a body wall that has a facial contour. The golf club head has a lug array comprising a plurality of lugs attached to the club head body. The golf club head also includes a first removable weight plate for providing the golf club head a first horizontal center of gravity, a first vertical center of gravity and a first Z-axis center of gravity. The first removable weight plate has a perimeter contour that substantially conforms to the facial contour of the body wall. It also has at least one weight plate mounting hole that is substantially aligned with at least one of the lugs in the lug array.

The golf club head of this embodiment also includes a first removable face plate having a perimeter contour that substantially conforms to the facial contour of the body wall. The first removable face plate has a first loft angle and a first bulge radius. It also includes at least one face plate mounting hole that is substantially aligned with at least one of the lugs in the lug array.

Preferably, the reconfigurable golf club head has a plurality of reinstallable fasteners, including at least one fastener that passes through a mounting hole in the first removable weight plate for attaching the first removable weight plate to the club head body. The reinstallable fasteners also include at least one fastener that passes through a mounting hole in the first removable face plate for attaching the first removable face plate to the club head body.

In some preferred embodiments, the reconfigurable golf club head includes a second removable weight plate for providing the club head a second horizontal center of gravity, a second vertical center of gravity and a second Z-axis center of gravity. In these embodiments, at least one of the second horizontal center of gravity, the second vertical center of gravity and the second Z-axis center of gravity is different from the first horizontal center of gravity, the first vertical center of gravity and the first Z-axis center of gravity. According to these preferred embodiments, the first removable weight plate may be removed from the club head body and replaced with the second removable weight plate to change the location of the center of gravity of the club head.

In some preferred embodiments, the reconfigurable golf club head includes a second removable face plate having a second loft angle and a second bulge radius, where at least one of the second loft angle and second bulge radius is different from the first loft angle and first bulge radius. According to these preferred embodiments, the first removable face plate may be removed from the club head body and replaced with the second removable face plate to change the loft angle or bulge radius of the club head.

Yet another preferred embodiment of the invention provides a reconfigurable golf club head having a club head body with a horizontal center of gravity, a vertical center of gravity and a Z-axis center of gravity. The club head body includes a cavity defined by a body wall having a facial contour and a back surface. This golf club head also includes a lug array comprising a plurality of lugs attached to the club head body. A first removable face plate is provided that has a first loft angle and a first bulge radius. The first removable face plate has a perimeter contour substantially conforming to the facial contour of the body wall and has at least one face plate mounting hole substantially aligned with at least one of the lugs in the lug array. Dampening material is disposed between the first removable face plate and the back surface of the club head body. A plurality of reinstallable fasteners pass through the mounting holes of the first removable face plate and attach the first removable face plate to the club head body. In some preferred embodiments, the golf club head includes a weight for adjusting the horizontal center of gravity, the vertical center of gravity or the Z-axis center of gravity. In these embodiments, the weight is disposed between the first removable face plate and the back surface of the club head body.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
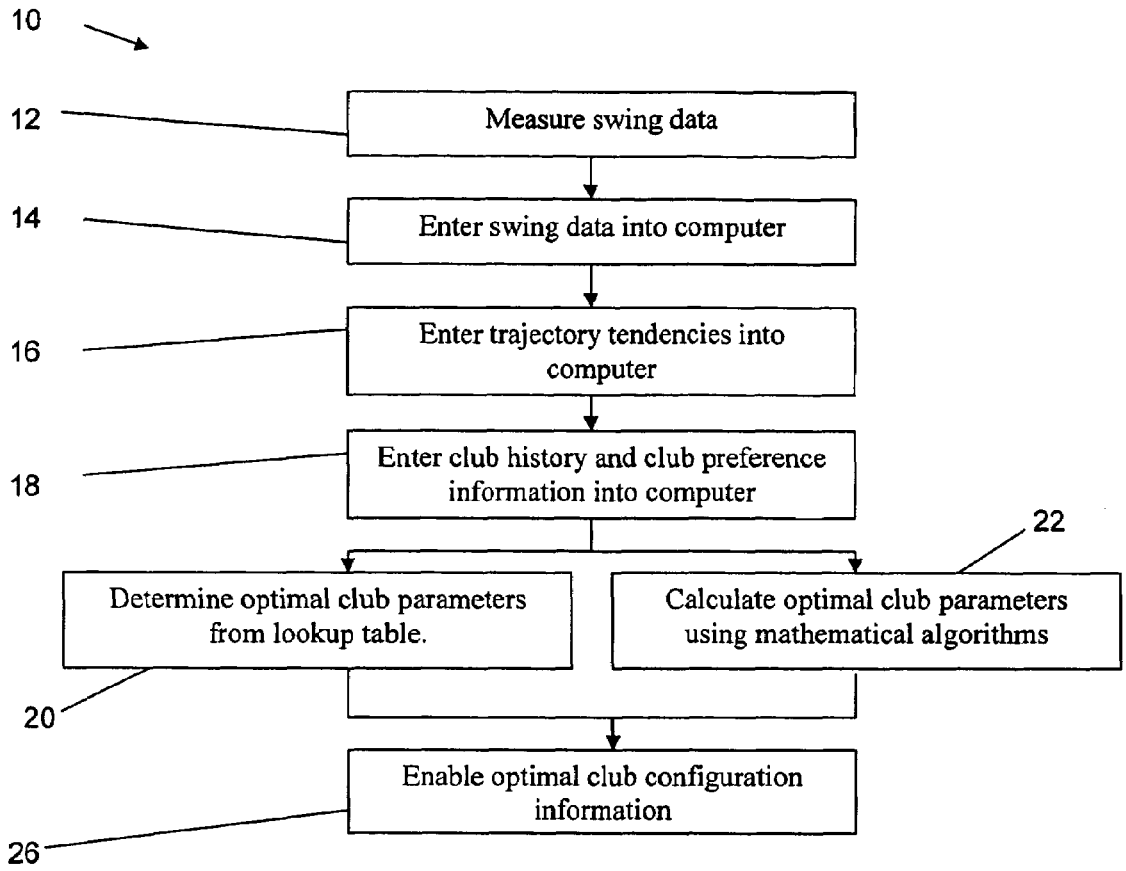
FIG. 1 is a flow chart according to a method of the invention.
Figure 2:
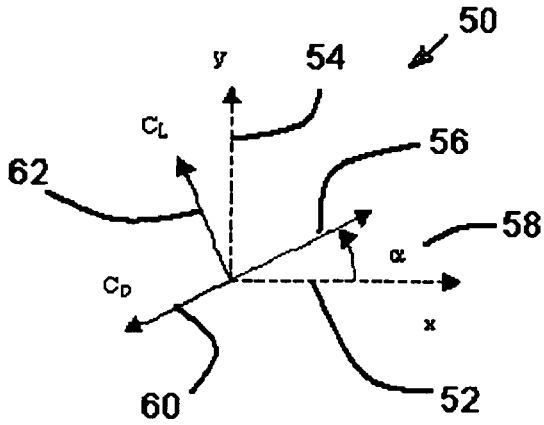
FIG. 2 depicts a coordinate system used in trajectory calculations.

In one aspect, the present invention provides a method for assessing the characteristics of a golfer's swing and using that information to determine certain golf club head design parameters that will optimize the golfer's swing. For example, one important determinant of optimal golf club design parameters for an individual golfer is the golfer's swing speed. Swing speed is the velocity of the club head at the instant the club head strikes the ball. Professional golfers typically have the ability to generate swing speeds well in excess of 100 miles per hour, often reaching 150 miles per hour. Less skilled golfers typically generate much lower speeds, with some golfers reaching less than 70 miles per hour. Swing speed is an example of swing information that can be determined for a specific golfer. Swing speeds may, for example, be quantitatively measured by electromagnetic means (e.g., a radar gun), by optoelectronic means (e.g., laser beam interruption) or by using high speed video or film cameras.

Swing speed is a primary determinant of the distance that a golf ball will carry through the air after it is struck by the club head. However, judicious selection of club head design parameters may increase the actual carry distance. One parameter that may be varied to enhance the carry distance from a lower swing speed is the loft angle of the club face. A higher loft angle launches the ball in a higher trajectory, and within limits, this higher trajectory increases the total carry distance of the golf ball. Loft angle is an example of a club head design parameter that may be optimized for a specific golfer.

Other swing information that may be used to determine optimal club head design parameters includes the angle of approach of the club when the golfer strikes the ball. A golf swing moves the golf club head in a generally circular motion, with the club head striking the ball near the bottom of the circle. When a golf ball is struck from a tee, it is generally best to strike the ball slightly after the club head has passed the bottom of the arc of the circular swing. This means that the club head is striking the ball while the club head is traveling on a slightly upward path. This is referred to as a positive angle of approach. If the club head strikes the golf ball at the precise bottom of the arc of the circular swing, the club head at that instant is moving parallel to the ground, and this is referred to as a zero angle of approach. If the club head strikes the ball before the arc of the swing has reached its lowest point, the club head strikes the ball on a slightly downward path and this is referred to as a negative angle of approach. A golfer's swing approach angle also affects the optimization of the loft angle design parameter for a golf club. Golfers with more positive approach angle swings need less loft angle in their clubs. The angle of approach of a golf club may be quantitatively measured by high speed cameras or computerized swing analyzers.

The swing speed achieved by an individual golfer typically does not vary significantly between similar golf clubs, such as between drivers of comparable head weight and shaft length. Consequently, a golfer may swing a test golf club in order to determine swing speed, and the measured swing speed will be sufficiently accurate to determine optimal club head design parameters for a golf club that is similar to the test golf club.

Besides swing information, other factors that may help determine optimal parameters in a golf club design for a specific golfer are trajectory tendencies of the golfer. For example, a golfer who slices or fades the ball (i.e., hits the ball on a horizontally curving path from left to right—for a right-handed golfer) may benefit from a club design that shifts the center of gravity toward the heel of the club head. A golfer who hooks or draws the ball (i.e., hits the ball on a horizontally curving path from right to left—for a right-handed golfer) may benefit from a club design that shifts the center of gravity toward the toe of the club head. Golfers who have difficulty in getting adequate loft in their golf shots may benefit from a golf club design that moves the center of gravity toward the sole of the club head, and golfers who hit the ball with excessive elevation may benefit from a golf club design that moves the enter of gravity toward the top surface of the club head. Swing information and trajectory tendency information are examples of swing characteristics of a golfer.

The optimal club head configuration for a particular golfer may also be determined by characteristics of the golf ball that the golfer will use with the club. In preferred embodiments, the present invention takes into account dynamic flight characteristics of the golf ball in determining the optimum loft angle and bulge and roll radii for a club head. For example, if a golf ball has a relatively high lift coefficient, the optimum club face would generally have a lower loft angle and larger bulge and roll radii to optimize the ball's flight trajectory. Golf balls having relatively high rotational inertias generally provide less spin, in which case a higher loft angle is generally desired to optimize the flight trajectory.

One of the factors affecting the lift and drag coefficients and rotational inertia of a golf ball is the dimple pattern on the surface of the ball. In a preferred embodiment of the invention, the computerized optimization method takes into account the dimple pattern of the ball in determining the optimum loft angle and bulge and roll radii for the club head. Preferably, the user of the method need not specify the exact geometric properties of the dimple pattern. Rather, the user specifies a particular brand and model of ball as part of the information provided to the program, and the program then determines the relevant flight characteristics of the specified ball based on a database of golf ball characteristics that is accessible to the program. In an alternative embodiment, the user may input information regarding properties of the ball that are provided by the ball manufacturer, such as information listed on a specification sheet packaged with a set of balls. Based on this ball information, the program then determines the relevant flight characteristics of the specified ball.

While these principles are helpful in guiding the parametric design of a golf club for a specific golfer, the process of implementation requires careful design. Parametric analysis generally requires sophisticated techniques that are not readily accessible to the average golfer. Computer software programs that optimize club design are generally very expensive. The ideal system for custom designing a golf club for a golfer would overcome that economic barrier Once accurate design information is generated, mechanisms should be provided for enabling the golfer to easily customize a club so that it conforms to the optimal design parameters.

FIG. 1 illustrates how these factors may be combined in various embodiments of a method for fitting a golf club. The method 10 includes acquiring swing information for the golfer (step 12). Preferably, at least swing speed and angle of approach information are acquired. This swing information is typically entered into club design software (step 14). In order to provide economical access to club design software, this swing information is preferably transmitted to a remote computer over a communication network. In the most preferred embodiments, the Internet (also known as the world-wide web) is used as the communication network. In alternative embodiments, the communication network may comprise a private or public intranet. In other alternative embodiments, the communication network may comprise a voice communication network, preferably including automated voice prompts to collect the required swing information. Alternatively, the method may be performed using software residing on a stand-alone computer.

In the preferred embodiment of the invention, the golfer also enters trajectory tendency information into the computer (step 16). As with the entry of swing speed and angle of approach information, the trajectory tendency information is preferably entered over a communication network. Trajectory tendency information may include qualitative information about the golfer's tendency to hook, draw, fade, or slice the ball. Alternatively or in addition, trajectory tendency information may include quantitative information such as dispersion data for a given number of shots. Dispersion data refers to the landing locations of golf balls hit by the golfer, where the locations may be determined by such processes as simulated trajectories or physical measurement of actual golf shots. Typically dispersion data are referenced to an average location, with the dispersion measurement for a particular shot calculated as the deviation from the average for that shot.

The golfer may also enter club history and club preference information into the computer, preferably using the communications network (step 18). Club history information may include design parameters of the club that was used by the golfer when the dispersion data were generated. Examples of such design parameters are loft angle, bulge radius, roll radius, weight distribution and so forth. These terms are defined in more detail hereinafter. Club preference information may include information about the golfer's preferences for these parameters in a club design. For example, a particular golfer may prefer a high bulge radius club for no particular analytical reason.

Based upon this input, the remote computer may determine optimal club head design parameters for the golfer using a lookup table (step 20). Table 1 illustrates an example of a lookup table method for determining optimal loft angle of a club head based on two swing information elements. Optimal loft angle is one example of an optimal club head design parameter. Alternatively or in addition, the computer may calculate optimal club design parameters using mathematical algorithms based on one or more swing information elements, such as approach angle and swing velocity, provided as input (step 22).

TABLE 1

Loft Angle as a Function of Approach Angle and Swing Speed

| | Approach Angle (degrees) | | | | |
|---|---|---|---|---|---|
| Swing Speed | +4 | +2 | 0 | −2 | −4 |
| <70 mph | 14° loft | 16° loft | 18° loft | 18° loft | 18° loft |
| 70-80 mph | 12° loft | 14° loft | 14° loft | 16° loft | 18° loft |
| 80-90 mph | 10° loft | 12° loft | 12° loft | 14° loft | 16° loft |
| 90-100 mph | 8° loft | 10° loft | 10° loft | 12° loft | 14° loft |
| >100 mph | 8° loft | 8° loft | 8° loft | 10° loft | 10° loft |

Referring to Table 1, if a golfer reports a swing speed of 85 miles per hour and an approach angle of +2 degrees, the remote computer may use a lookup table such as depicted in Table 1 to recommend a club loft angle of 12°.

Table 2 illustrates an example of a method for determining the location of the optimal center of gravity of a club head based on club head speed and approach angle. Optimal center of gravity location is another example of an optimal club design parameter. In Table 2, the optimal center of gravity location is referenced to the club face centroid. The club face centroid is the geometric centroid of the face of the golf club head. Alternative tables for determining optimal center of gravity may be developed using different frames of reference.

TABLE 2

Center of Gravity (Vertical Offset in Inches Referenced to Face Centroid) as a Function of Angle of Approach and Swing Speed

| | Angle of Approach (degrees) | | | | |
|---|---|---|---|---|---|
| Swing Speed | +4 | +2 | 0 | −2 | −4 |
| <70 mph | −0.25 | −0.30 | −0.35 | −0.40 | −0.45 |
| 70-80 mph | −0.25 | −0.30 | −0.30 | −0.35 | −0.40 |
| 80-90 mph | −0.20 | −0.25 | −0.25 | −0.30 | −0.35 |
| 90-100 mph | −0.10 | −0.15 | −0.20 | −0.25 | −0.20 |
| >100 mph | −0.05 | −0.10 | −0.15 | −0.20 | −0.20 |

Using Table 2, if a golfer reports a swing speed of 75 miles per hour and an approach angle of 0 degrees, the remote computer may use a lookup table such as depicted in Table 2 to recommend that the center of gravity of the club head be located −0.30 inches from the club face centroid (i.e., 0.30 inches below the centroid).

In some embodiments, the remote computer executes mathematical algorithms to generate impact and trajectory simulations which are used in determining optimal club head design parameters (step 22). For example, in one preferred embodiment, the computer software implements three-dimensional impact and trajectory models such as those developed by D. C. Winfield and Teong E. Tan as described in "Optimization of the Clubface Loft and Swing Elevation Angles for Maximum Distance of a Golf Drive," Computers & Structures, Vol. 53, No. 1, pp. 19-25, 1994, and "Optimization of the Clubface Shape of a Golf Driver to Minimize Dispersion of Off-Center Shots," Computers & Structures, Vol. 58, No. 6, pp. 1217-1224, 1997. These trajectory models are also described in U.S. Pat. Nos. 6,241,622, 6,488,591, 6,500,073 and 6,764,412, which descriptions are incorporated herein by reference. Given club head velocity and approach angle, the impact model is used to determine post-impact ball velocity and spin. Given the post-impact ball velocity and spin, the trajectory model is used to determine the flight path of the ball.

In those embodiments that use trajectory simulation to determine optimal club head design parameters, one or more of those parameters are varied over a range and the carry distance of the golf ball is determined for each variation. In this manner, the optimal design parameters may be determined from the simulations (step 24). Generally, the optimal design parameters are those parameters that result in the longest carry distance. However, in some instances, the golfer may desire to reduce dispersion, at the expense of some loss of carry distance. In such cases, the computer may calculate both carry distance and dispersion, and use the golfer's indication of preference to reach an optimal balance of club design parameters for that golfer. In some embodiments, the golfer's indication of preference is determined by a golfer's interactive modification of parameters on the remote computer and depiction of trajectory results based on such modification of parameters.

As previously indicated, some embodiments employ one or more lookup tables (step 20) to determine optimal club head design parameters, and some embodiments employ mathematical algorithms, such as impact and trajectory simulations, to optimize club head design parameters (step 22). In addition, some embodiments employ a combination of these two methods for determining optimal club head design parameters.

Once the optimal club head design parameters have been determined, assembly of an optimized golf club is enabled (step 26), such as by establishing a mechanism for physically configuring a golf club head that conforms to the optimal design parameters. In some embodiments, the golfer is furnished a kit that includes alternative or reconfigurable components that may be assembled into the desired club head configuration. In such implementations, step 26 may comprise having the remote computer instruct the golfer over the network, for example, to "Combine weight plate 'C' and face plate '2'." In other embodiments, step 26 for enabling assembly of the club for the golfer may comprise determining the appropriate club configuration based on the optimal club head design parameters, and shipping the appropriate golf club head components and assembly instructions to the golfer. In yet another embodiment, this step may comprise shipping a fully assembled club to the golfer.

Figure 3:
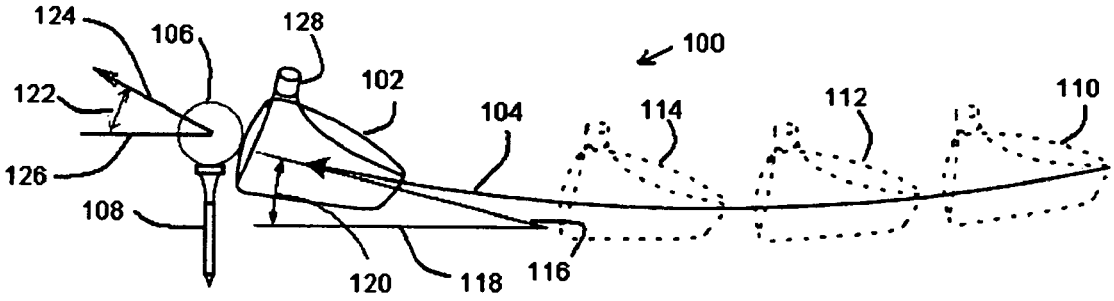
FIG. 3 is a side view of the path of a club head as it strikes a golf ball.

FIGS. 3 through 12 describe further details of swing information elements, club history and preference information, and golf club head design parameters. FIG. 3 provides details of the approach angle calculation for a golf club swing path 100 in which a club head 102 is swung through an arc 104. The golf club head 102 has a hosel 128 which attaches to a golf club shaft that the golfer uses to swing the club head 102. The arc 104 is oriented so that the club head 102 strikes a golf ball 106 that is placed on a tee 108. As the club head 102 progresses along the arc 104, it passes through a series of positions 110, 112 and 114 illustrated by the phantom lines in FIG. 3. At the instant it strikes the golf ball 106, the club head 102 is traveling in a direction and at a swing speed indicated by the velocity vector 116. The direction of the velocity vector 116 with respect to horizontal reference line 118 is called the angle of approach 120. When the club head 102 strikes the golf ball 106, the golf ball 106 is propelled in a direction and at a velocity indicated by the vector 124.

Figure 4:
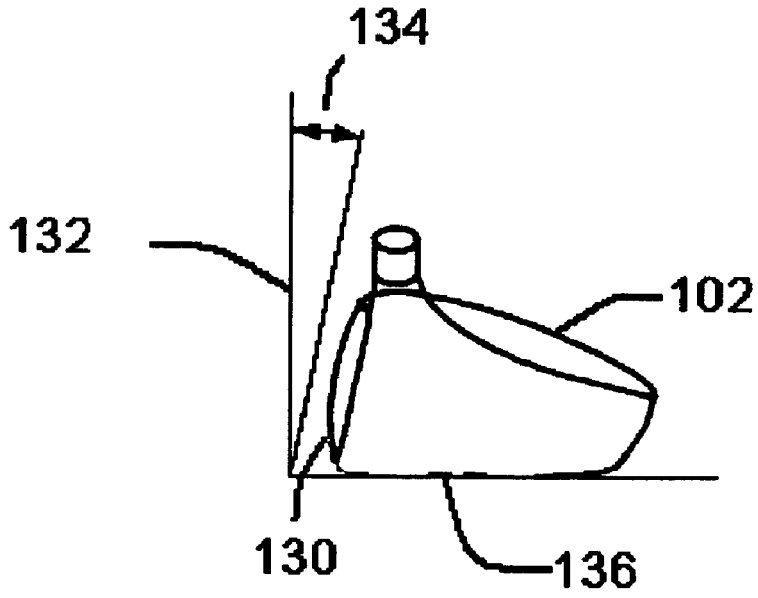
FIG. 4 is an elevation view of a golf club head depicting the loft angle.

The direction of the vector 124 with reference to the horizontal reference line 126 is called the launch angle 122. The launch angle 122 is a function of the angle of approach 120 and the loft angle of the club head 102. FIG. 4 depicts the relationship between the loft angle 134, the face 130 of the club head 102 and the vertical reference line 132. To properly measure the loft angle 134, the club head 102 should be positioned to rest on the horizontal reference line 136 that is orthogonal to the vertical reference line 132.

Figure 5:
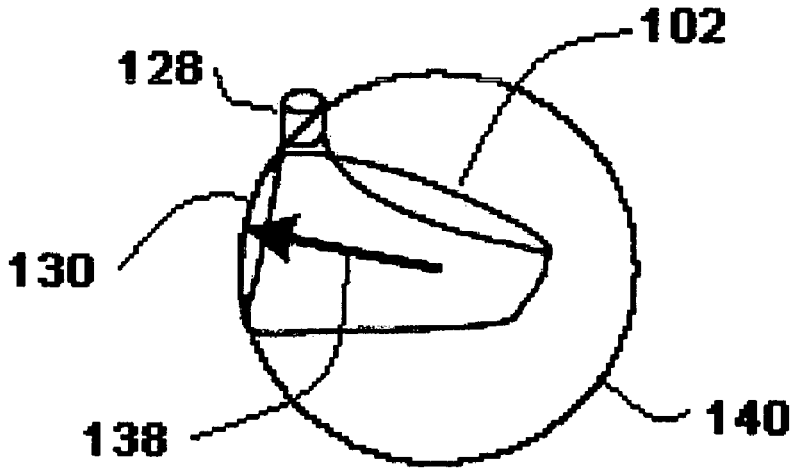
FIG. 5 is an elevation view of a golf club head depicting the roll radius.

FIG. 4 illustrates that the face 130 of the club head 102 is generally not a planar surface. Instead, it is typically radial in configuration when viewed from the side as depicted in FIG. 4. This radial characteristic, called the roll radius, is preferably considered in the calculation of the loft angle 134. FIG. 5 depicts the roll radius 138 which may be determined by a best-fit of the circle 140 to match the radius of the face 130 of the club head 102 The specific arrow depicting the roll radius 138 in FIG. 5 should intersect the club face 130 at its midpoint in the vertical plane. The tangent to the roll radius 138 at that intersection point establishes the loft angle 134 of the club head. The roll radius 138 is another example of a club head parameter that may be optimized in some embodiments of the invention. Lookup tables and/or mathematical algorithms, such as impact and trajectory simulations, may be used to determine the optimal roll radius for a particular golfer.

Figure 6:
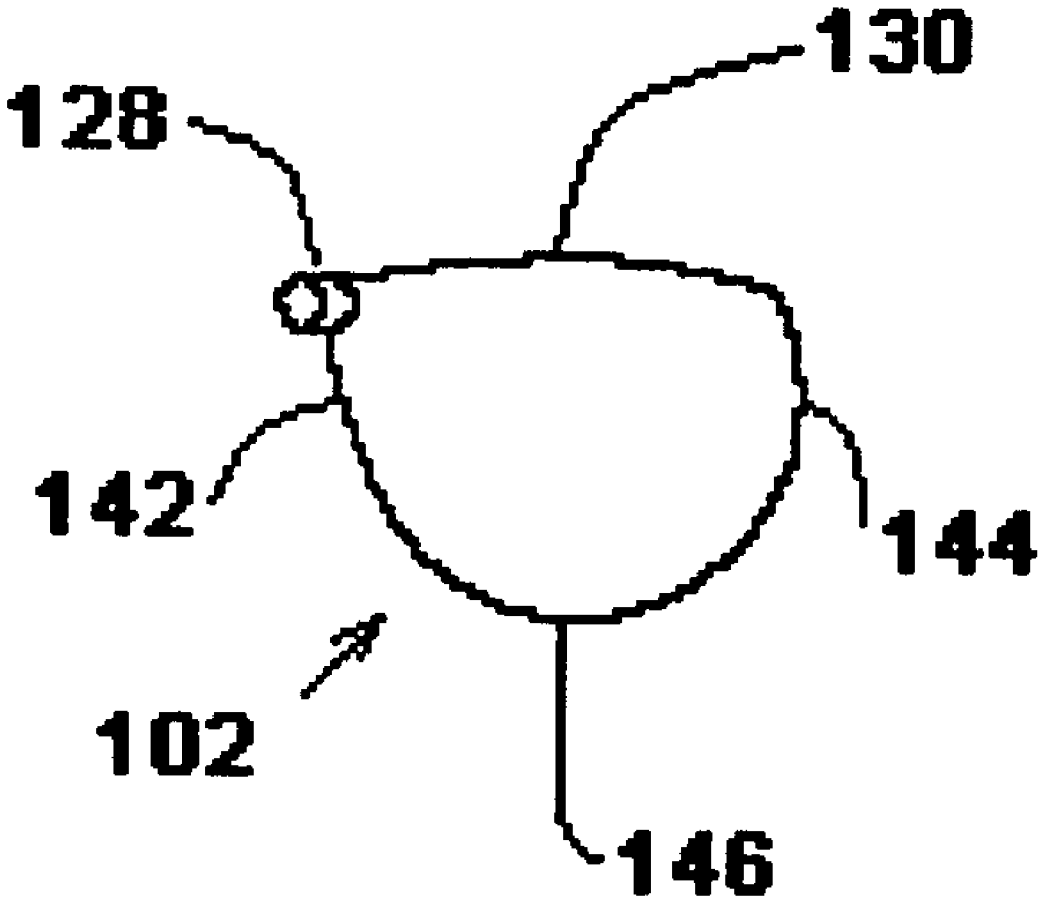
FIG. 6 is an overhead view of a golf club head.

FIG. 6 illustrates reference features of a golf club head 102 that are useful in describing embodiments of the invention. As viewed from the top, the club head 102 has the previously referenced club face 130 and hosel 128. A feature on the club head 102 that is proximal to the hosel 128 is the heel 142 of the club head 102. The feature opposed to the heel 142 is called the toe 144 of the club head 102. The feature opposed to the club face 130 is called the back 146 of the club head 102.

Figure 7:
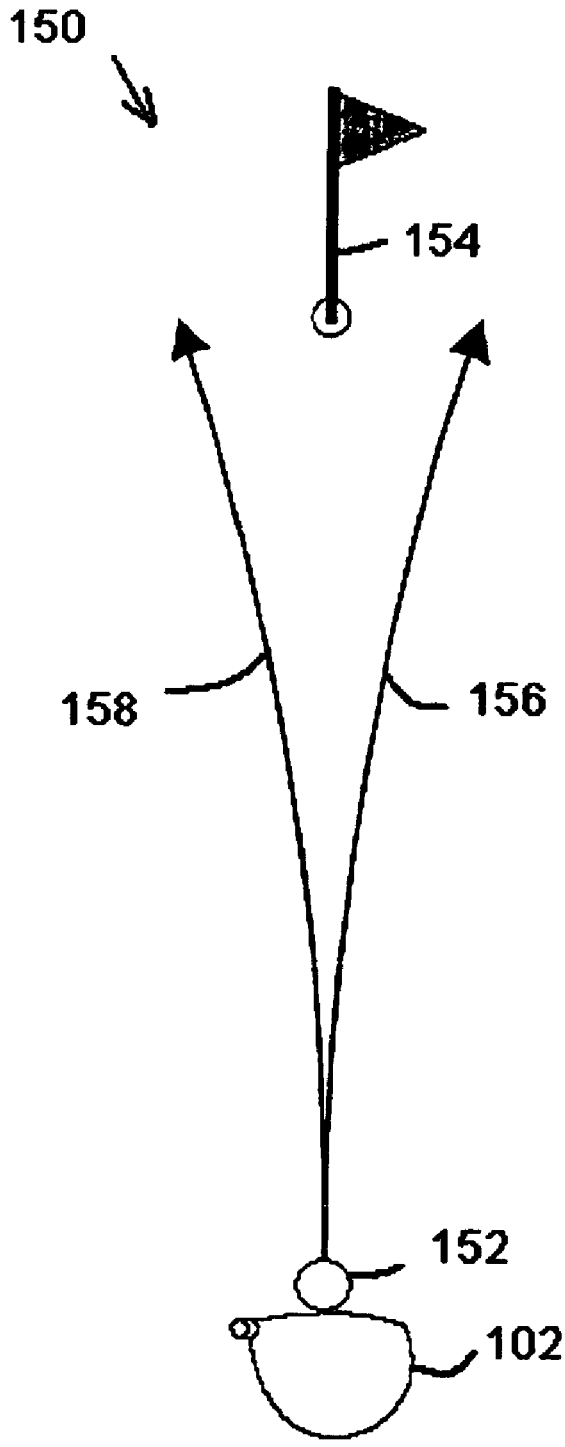
FIG. 7 depicts the difference between a draw and a fade in a golf ball trajectory.

FIG. 7 illustrates examples of trajectory tendency information for various golfers. In particular, a range of ball working paths 150 is depicted. While a golfer usually intends to propel the golf ball 152 directly toward the target pin 154, the actual trajectory generally varies. A path 156 illustrates what is called a fade in common golf terminology. A severe fade is called a slice. A path 158 illustrates a draw. A severe draw is called a hook.

Figure 8:
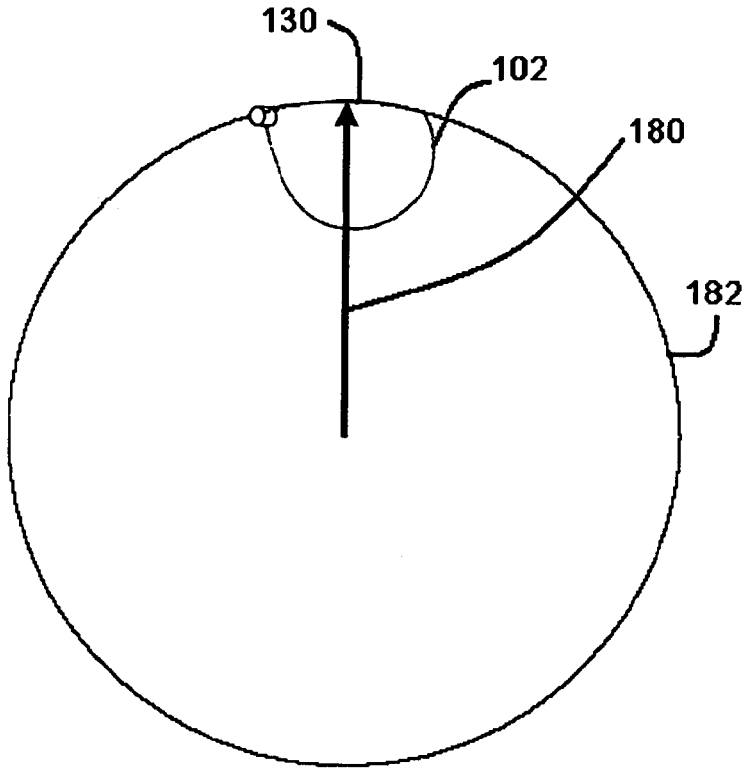
FIG. 8 is an overhead view of a golf club head depicting the bulge radius.

One of the factors that affects a golf ball trajectory is the bulge radius. FIG. 8 illustrates the determination of the bulge radius 180 for the club head 102. Circles of various radii are drawn across the face 130 of the club head 102, and a best-fit circle 182 is determined. The radius of the best-fit circle 182 defines the bulge radius 180 of the club head 102.

The bulge radius 180 is another example of a club head parameter that may be optimized in some embodiments of the invention. Golfer's who do not consistently strike a golf ball at the center of the face of a club head generally benefit from an optimized bulge radius. This is due to a factor called the "gear effect." The gear effect generates a counterclockwise spin when the club head strikes the ball toward the toe of the club and a clockwise spin when the club head strikes the ball toward the heel. When the ball is struck toward the toe of the club, the bulge propels the ball off the target line in a manner that the natural spin brings the ball back toward its intended target. The opposite is true when the ball is struck toward the club's heel. Either lookup tables or mathematical algorithms, such as impact and trajectory simulations, may be used to determine the optimal bulge radius for a particular golfer.

Figure 9:
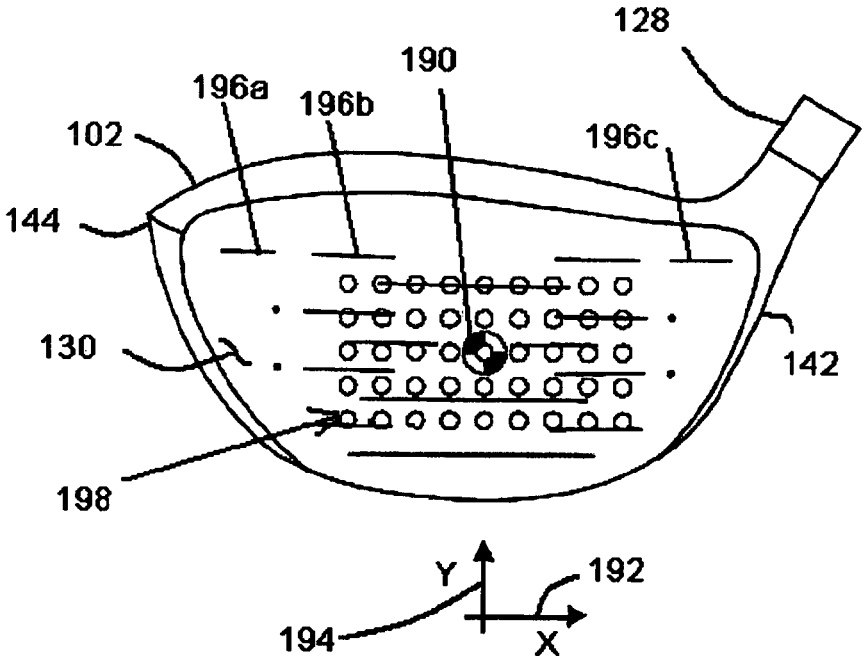
FIG. 9 is a front view of a golf club head showing impact positions used in modeling ball flight dispersion patterns.

FIG. 9 illustrates various locations 198 on a club face 130 where the face may contact a golf ball. Most golf clubs perform best when the golf ball is struck at the "sweet spot" 190. The sweet spot 190 is the position on the face plate 130 that is on a line perpendicular to the face plate 130 and which passes through the center of mass of the club head 102. Because golf swings are not always perfect, the actual location of a ball strike varies in the horizontal 192 and vertical 194 directions. Balls struck at the different positions 198 will follow different trajectories, resulting in a dispersion of landing locations. Striking locations 198 that are away from the sweet spot 190 represent mis-hits, which are typically measured as deviations from the sweet spot 190. The actual landing locations are a function of mis-hit deviations, bulge radius, roll radius, golf club center of gravity, groove pattern and so forth. Landing locations for various mis-hit deviations may be determined by simulation or actual physical measurements based on sampling of a number of actual shots made by a particular golfer. Various club head design parameters may be optimized in view of mis-hit deviations experienced by a specific golfer.

Another factor that may affect the flight of a golf ball are grooves formed in the club face 130, such as the grooves 196*a*, 196*b* and 196*c* depicted in FIG. 9. These grooves are designed to control the spin of a golf ball and to control sliding of the ball up the club face 130.

Figure 10:
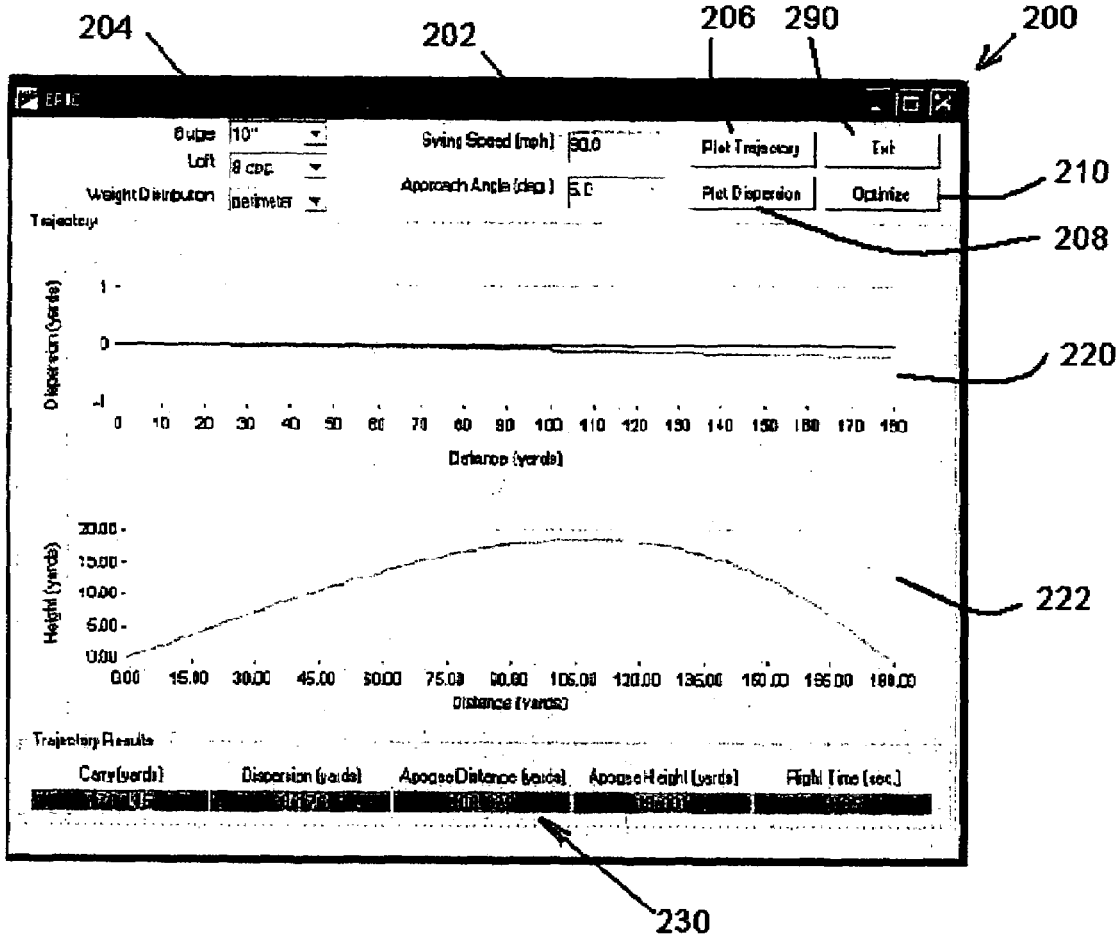
FIG. 10 is a computer screen image generated by computer software for optimizing golf club parameters.
Figure 11:
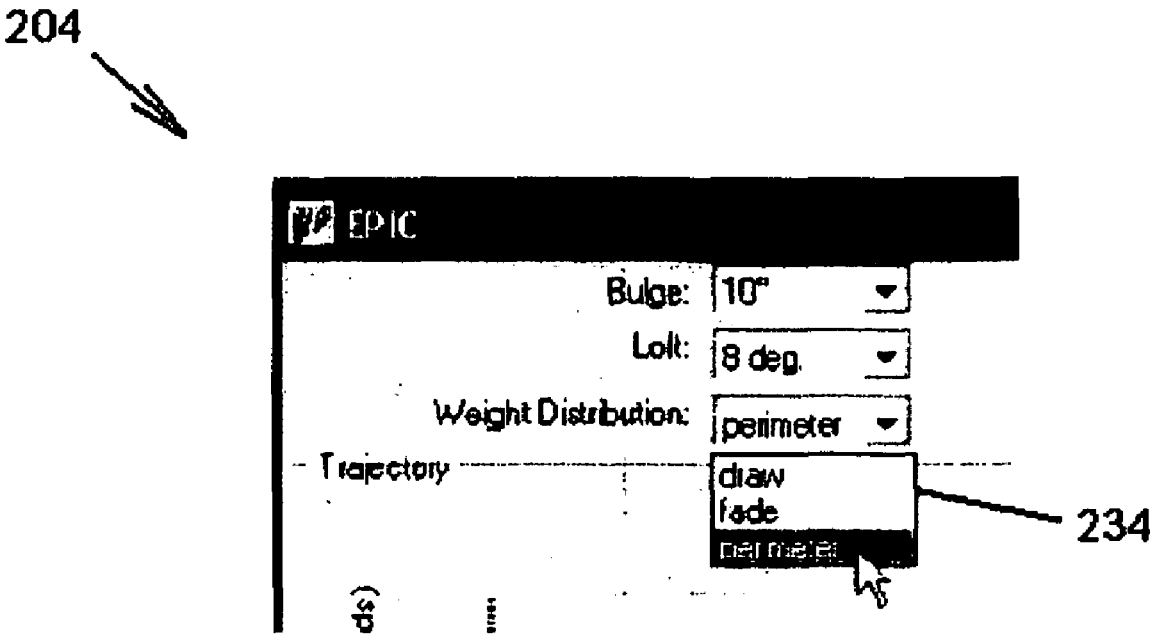
FIG. 11 is a detail of a portion of the screen image of FIG. 10, showing a pull-down menu.

FIG. 10 illustrates a screen 200 generated by simulation software implemented in a preferred embodiment of the invention that determines optimal club head parameters for a particular golfer. Among other features, the software permits a user to change golf club design parameters and observe the effect each change has on the resultant ball trajectory. Preferably, the simulation screen 200 provides input boxes 202 for swing data such as swing speed and angle of approach (approach angle). Preferred club head design parameters may be entered in the boxes 204. FIG. 11 illustrates details about how such preferred club head design parameters may be entered into the boxes 204, such as by use of a drop-down menu 234. As shown in FIG. 10, the software provides an actuating button 206 for plotting simulated golf ball trajectory, a button 208 for plotting landing ball dispersion data, and a button 210 for determining optimal golf club design parameters.

When the user presses the trajectory button 206, the preferred embodiment of the software produces a top view 220 and an elevation view 222 of a simulated golf ball trajectory resulting from striking the ball at the sweet spot (190 in FIG. 9). A preferred embodiment of the software also displays in the area 230 the carry distance, dispersion distance from the center line, apogee height, distance downrange and flight time.

Figure 12:
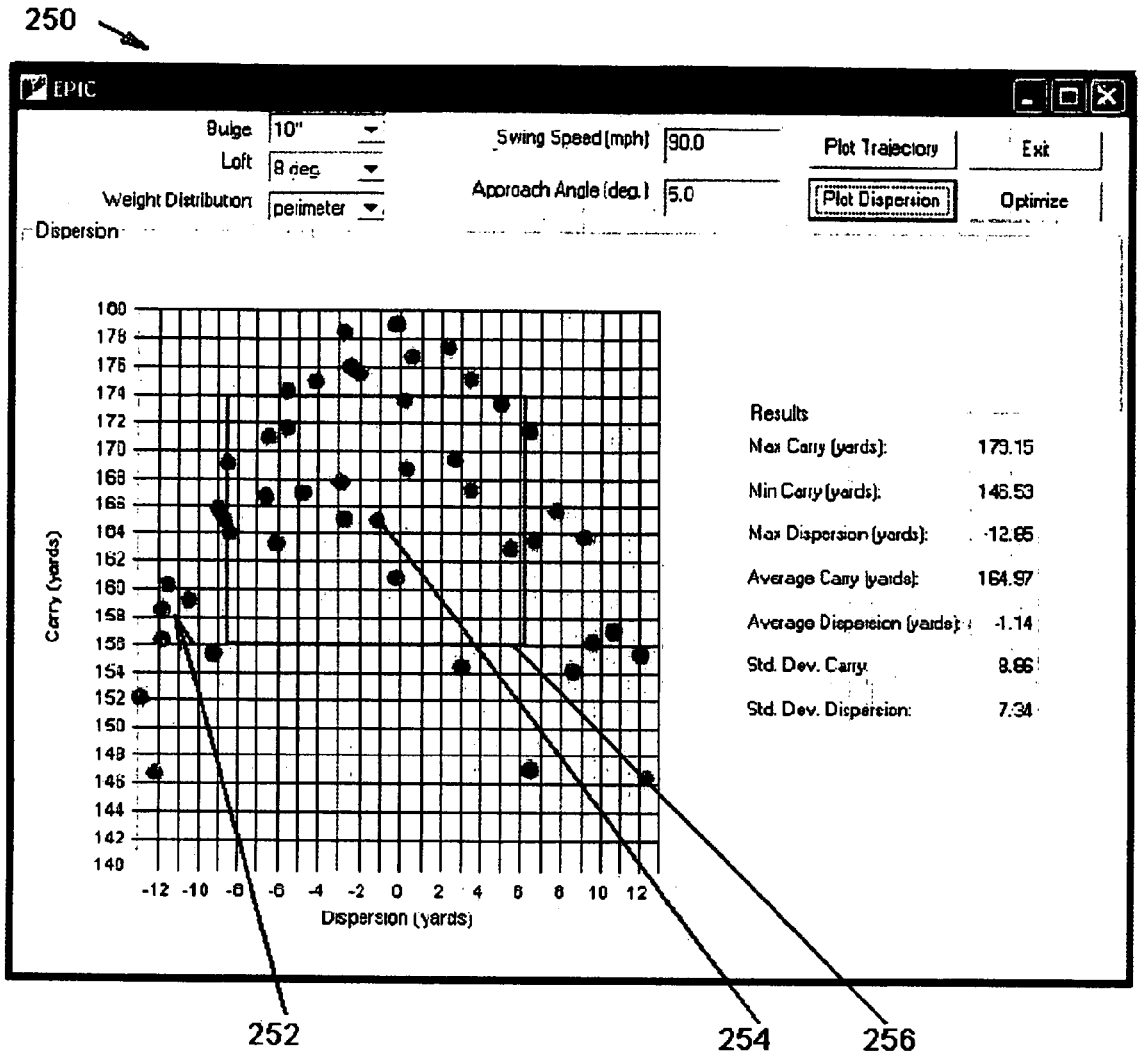
FIG. 12 is a computer screen image generated by computer software for optimizing golf club parameters.

When the button 208 is selected, the preferred embodiment of the software calculates landing positions resulting from the various different impact locations 198 on the club face. FIG. 12 illustrates a resultant dispersion data display 250 generated by a preferred embodiment of the invention, wherein simulated or measured golf ball landing locations 252 are depicted. The "average" (geometric centroid) landing location 254 is depicted in a box 256 that graphically depicts one standard deviation in the dispersion data.

When the optimize button 210 is selected, the preferred embodiment of the software uses the golfer's swing speed and angle of approach information to determine the optimum club head loft angle to maximize carry distance for a center hit. The software also preferably determines the optimum bulge radius to minimize dispersion in golf ball landing locations. In a preferred embodiment, the software sets the bulge and loft drop-down boxes (area 204 in FIG. 11) to show the optimal club head design parameters that were determined, and it plots the resultant trajectory graph (FIG. 10). If the user wishes to see the dispersion pattern that results when these optimal club head design parameters are used in the simulation, the dispersion button 208 may be depressed and a new dispersion chart 250 (FIG. 12) is presented.

Figure 13:
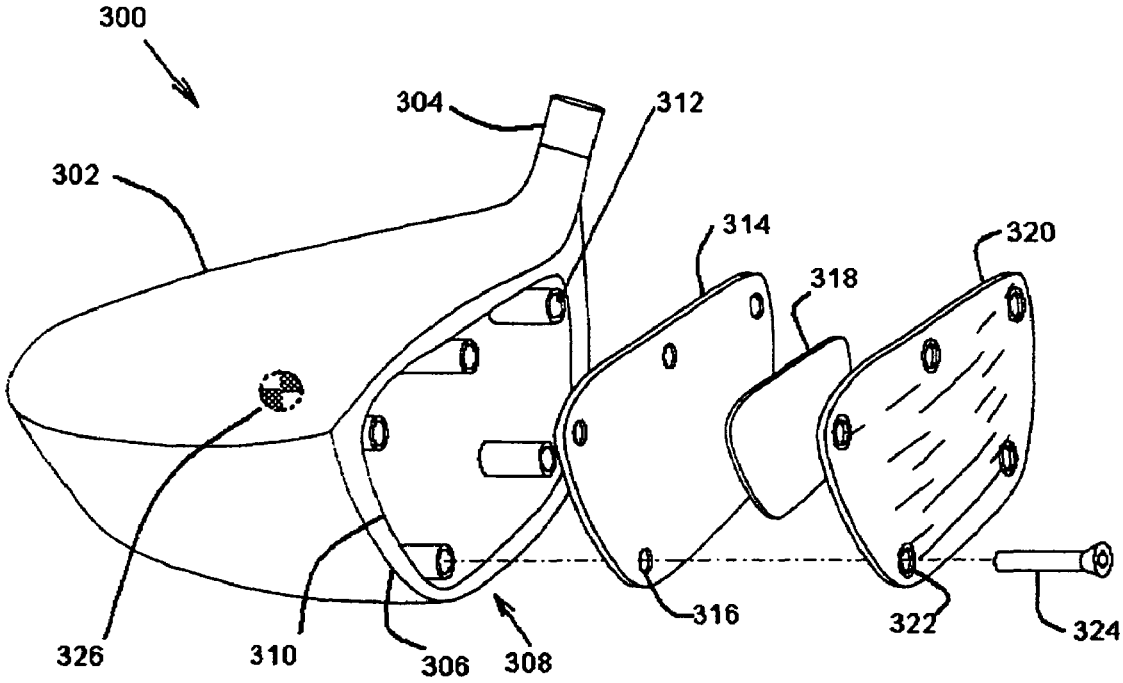
FIG. 13 is a perspective view of a golf club head.

While determination of optimal golf club head design parameters is an important objective, an equally important aspect of the invention is providing a club head that may be reconfigured to attain the optimal design parameters. FIG. 13 represents one embodiment of such a reconfigurable golf club head 300 which includes a body 302 and a hosel 304. The body 302 comprises a body wall 306 that defines a cavity 308 in the body 302. The body wall 306 also forms a facial contour 310 that is defined by the outline of the cavity 308 at the front of the body 302. An array of lugs 312 are attached to the body 302 inside the cavity 308. Preferably, the lugs 312 are welded to the body 302, and each lug 312 has internal threads to receive a mating screw. In some embodiments, a weight plate 314 is provided having a perimeter contour substantially conforming to the facial contour 310 of the body wall 306. With such a contour, the weight plate 314 fits within the cavity 308 and abuts against the ends of the lugs 312. The weight plate 314 also has mounting holes 316 configured in a pattern wherein at least some of the holes 316 match the hole pattern established by the array of lugs 312. The weight plate 314 may be manufactured having various masses and weight displacement configurations, where all have substantially the same perimeter contour dimensions and hole placement.

In the most preferred embodiments, dampening material 118 is positioned between the weight plate 314 and the face plate 320. Preferably, the dampening material 118 is a "constrained layer" dampening material that dissipates the vibration energy of the golf club head 300 when it strikes a golf ball. Such energy reduction is helpful in reducing the potential for discomfort and injury to a golfer resulting from the shock and vibration of the club head upon ball impact.

The face plate 320 preferably has a perimeter contour substantially conforming to the facial contour of the body wall 306, so that it fits within the cavity 308. The face plate 320 also has mounting holes 322 positioned to align with at least some of the lugs 312 in the lug array. Different face plates 320 may be manufactured with various bulge, roll, and loft characteristics so that a golfer may select the best combination for his particular needs. For example, the bulge and roll radii may be optimized to a golfer's swing speed and angle of approach to minimize the dispersion due to mis-hits.

Mounting screws 324 are provided to attach the weight plate 314 and the face plate 320 to the club head body 302 using the lugs 312. The mounting screws 324 are an example of a reinstallable fastener, meaning a fastener that may be removed and replaced to reconfigure the club head 300. Other examples of reinstallable fasteners are pop rivets, snap rings, detents, friction bearings and removable adhesives.

When the reconfigurable golf club head 300 is assembled, it has an intrinsic center of gravity 326 and inertia dyadic. The X-Y location of the center of gravity 326 (referenced to the X and Y axes in FIG. 9) is established in a geometric plane corresponding to the face of the golf club which is referred to herein as the face plane center of gravity. The inertia dyadic and center of gravity of a golf club head may be shifted by making some portions of the weight plate 314 have greater mass than others, such as by adjusting the thickness of the plate 314 or adding displacement weights. For example, the weight plate 314 may adjust the face plane center of gravity 326 so that most of the club head mass is located toward the heel side of the club head to facilitate a draw. In another example, the weight plate 314 may cause most of the club head mass to be located towards the toe side of the club head to facilitate a fade.

The inertia dyadic of the golf club head may be increased without shifting the center of gravity by moving most of the mass of the weight plate 314 toward its perimeter. This has the effect of decreasing the dispersion due to off-center mis-hits. Generally, the most useful application of perimeter weighting is to have two substantially equal masses, with one positioned near the heel of the club head and the other near the toe. Another possibility is to have two substantially equal masses, with one positioned near the crown and one near the sole. Alternatively, mass could be distributed substantially equally around the entire perimeter of the weight plate.

Figure 14:
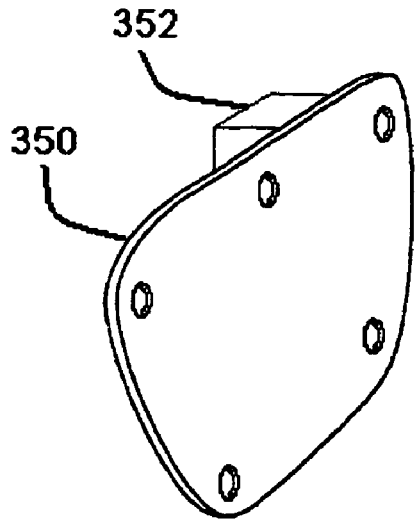
FIG. 14 is a perspective view of a weight plate with a horizontal center of gravity displacement weight.
Figure 15:
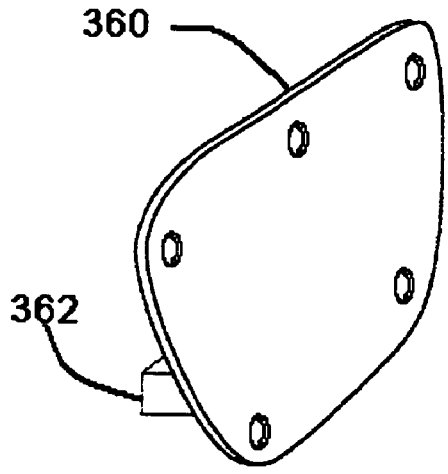
FIG. 15 is perspective view of a weight plate with a vertical center of gravity displacement weight.
Figure 16:
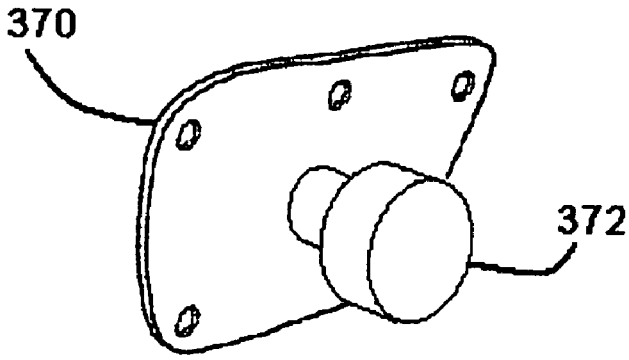
FIG. 16 is a perspective view of a weight plate with a Z-axis center of gravity displacement weight.

Various alternative embodiments allow weights to be added by screwing them to the weight plate in any number of configurations. Weight displacement of the club head may also be adjusted by sliding a movable weight along a bar attached to the back of the weight plate, such as in a dovetail configuration. For example, FIG. 14 illustrates one configuration of a weight plate 350 having a weight 352 for displacing the horizontal center of gravity of a club head. FIG. 15 illustrates a weight plate 360 having a weight 362 for displacing the vertical center of gravity of a club head. FIG. 16 illustrates a weight plate 370 having a weight 372 for displacing the Z-axis center of gravity of a club head. A Z-axis center of gravity displacement weight moves the center of gravity of a club head in the direction orthogonal to the X and Y axes depicted in FIG. 9, i.e., in the direction from the club face to the back of the club. While various embodiments depicted herein illustrate vertical, horizontal and Z-axis center of gravity displacement weights, preferred embodiments of the invention incorporate a combination of such weights. The optimum weight plate configuration typically comprises a weight plate that optimizes ball carry for a particular golfer's needs.

Figure 17:
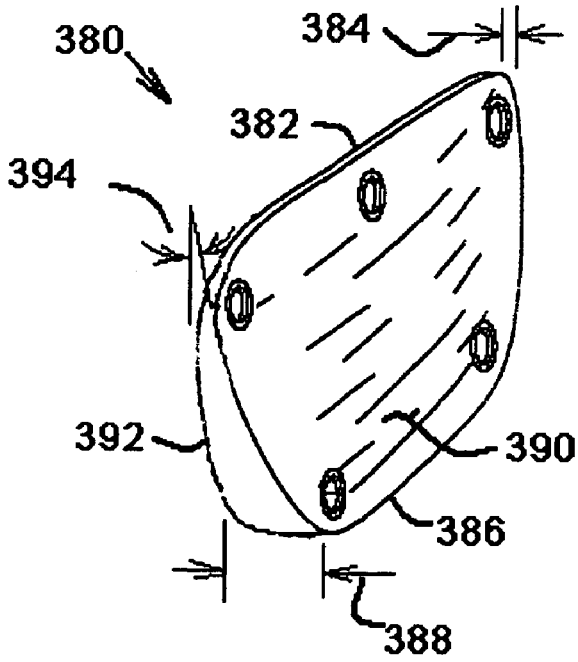
FIG. 17 is a perspective view of a face plate for a golf club head.

FIG. 17 illustrates one method for adjusting the loft angle of a club head face. The club face 380 has a top surface 382 with a thickness 384 and a bottom surface 386 with a thickness 388. The front 390 of the club face 380 strikes the golf ball and the rear 392 of club face 380 is inserted into the cavity (308 in FIG. 13) of the club head body (302 in FIG. 13). Club faces 380 having various loft angles 394 may be realized by varying the ratio of the thickness 388 to the thickness 384. The optimum face plate configuration typically comprises a face plate with a loft angle that maximizes ball carry for a particular golfer's swing characteristics.

In an alternative embodiment, the loft angle may be adjusted by the placement of washers of various thicknesses behind the face plate. For example, in the reconfigurable club head shown in FIG. 13, washers could be placed between one or more of the lugs 312 and the weight plate 314. Alternatively, washers could be placed between the weight plate 314 and the face plate 320 in alignment with one or more of the holes 316 and 322. In this embodiment, the number and location of the washers would determine the loft angle of the club head.

Figure 18:
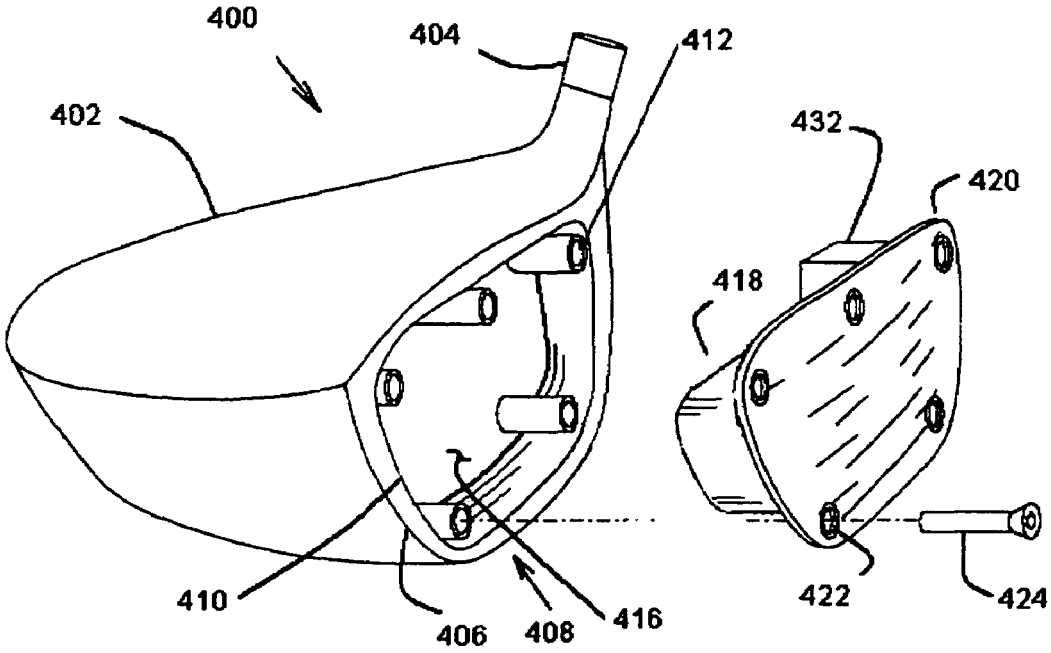
FIG. 18 is a perspective view of a golf club head.

FIG. 18 illustrates an alternative embodiment of the invention that does not employ a separate weight plate. The reconfigurable club head 400 has a body 402 comprising a body wall 406 that defines a cavity 408. The body wall 406 also forms a facial contour 410 that is defined by the outline of the cavity 408 at the front of body 402. The body 402 also has a back surface 416 that, as shown in FIG. 18, may be co-planar with the facial contour 410, or may be irregularly shaped. An array of lugs 412 are attached to the body 402 inside the cavity 408. Preferably the lugs 412 are welded to the body 402, and each lug 412 has internal threads to receive a mating screw.

A face plate 420 has a perimeter contour that substantially conforms to the facial contour of the body wall 406 so that the face plate 420 fits within the cavity 408. The face plate 420 also has mounting holes 422 positioned to align with the lugs 412 in the lug array. The face plate 420 preferably has dampening material 418 attached to the rear surface thereof. Preferably, the damping material 420 is sized to press against the back surface 416 of the body 402 when the face plate 418 is assembled to the body 402. A weight 432 for displacing the horizontal center of gravity is preferably attached to the rear of the face plate 420. Additionally or alternatively, a weight for displacing the vertical center of gravity may be employed. Mounting screws 424 are provided to attach the face plate 420 to the body 402.

In one preferred embodiment of the invention, a golfer may use the software described above to determine the optimum face plate 320 and weight plate 314 to attach to the golf club body 302. In addition, such software may provide a golfer with information about optimal golf club shaft characteristics, such as stiffness, kick-point location, and so forth. The overall optimum configuration of a golf club for a golfer may include optimal club head configuration information and the optimum configuration may include optimal golf club shaft characteristics. To purchase a golf club of optimum configuration, the golfer may access a website on the Internet to purchase a club having a head with interchangeable faceplates and weight plates, and a shaft having particular desired characteristics. In an alternative example, the golfer may visit a golf equipment retail store and access an in-store computer terminal to purchase a club. The web site and the in-store computer terminal are examples of interactive purchasing interfaces that may be accessed by golfers. As part of the purchase process, the golfer may run software via the website or in-store terminal to determine which face plate and weight plate configurations should be purchased with the club. Alternatively, the golfer may download the software or obtain the software on a disk and use it on a stand-alone computer to determine the optimum configuration of the club. Once the optimum configuration is determined, the golfer may access a website or an in-store terminal to purchase the club, or the golfer may place a phone call to order the club. The purchasing process typically involves having the golfer provide a purchase order using the purchasing interface. The purchase order typically comprises credit card information and a shipping address.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A reconfigurable golf club head comprising:

a club head body having a cavity defined by a body wall having a facial contour;

a lug array comprising a plurality of lugs attached to the club head body;

a first removable weight plate for providing the golf club head a first horizontal center of gravity, a first vertical center of gravity and a first Z-axis center of gravity, the first removable weight plate having a perimeter contour substantially conforming to the facial contour of the body wall and having at least one weight plate mounting hole substantially aligned with at least one of the lugs in the lug array;

a first removable face plate having a perimeter contour substantially conforming to the facial contour of the body wall, having a first loft angle, a first bulge radius and a first roll radius, and having at least one face plate mounting hole substantially aligned with at least one of the lugs in the lug array; and a plurality of reinstallable fasteners including at least one fastener that passes through the at least one mounting hole in the first removable weight plate and attaches the first removable weight plate to the club head body, and including at least one fastener that passes through the at least one mounting hole in the first removable face plate and attaches the first removable face plate to the club head body.

2. The reconfigurable golf club head of claim 1 further comprising dampening material disposed between the first removable weight plate and the first removable face plate.

3. The reconfigurable golf club head of claim 1 further comprising:

a second removable weight plate for providing the golf club head a second horizontal center of gravity, a second vertical center of gravity and a second Z-axis center of gravity, where at least one of the second horizontal center of gravity, the second vertical center of gravity and the second Z-axis center of gravity are different from the first horizontal center of gravity, the first vertical center of gravity and the first Z-axis center of gravity, and where the second removable weight plate has a perimeter contour substantially conforming to the facial contour of the body wall and has at least one weight plate mounting hole substantially aligned with at least one of the lugs in the lug array; and the plurality of reinstallable fasteners including at least one fastener that passes through the at least one mounting hole in the second removable weight plate and attaches the second removable weight plate to the club head body, whereby the first removable weight plate may be removed from the club head body and replaced with the second removable weight plate.

4. The reconfigurable golf club head of claim 1 further comprising:

a second removable face plate having a second loft angle, a second bulge radius and a second roll radius, where at least one of the second loft angle, second bulge radius and second roll radius is different from the first loft angle, first bulge radius and first roll radius, and where the second removable face plate has a perimeter contour substantially conforming to the facial contour of the body wall and has at least one face plate mounting hole substantially aligned with at least one of the lugs in the lug array;

the plurality of reinstallable fasteners including at least one fastener that passes through the at least one mounting hole in the second removable face plate and attaches the second removable face plate to the club head body, whereby the first removable face plate may be removed from the club head body and replaced with the second removable face plate.

5. The reconfigurable golf club head of claim 1 wherein an optimal configuration for the first removable weight plate is determined based at least in part on information related to golf club swing characteristics of a golfer who is to use the golf club head.

6. The reconfigurable golf club head of claim 5 wherein one or more of the first horizontal center of gravity, the first vertical center of gravity and the first Z-axis center of gravity of the first removable weight plate is determined based at least in part on information related to golf club swing characteristics of the golfer who is to use the golf club head.

7. The reconfigurable golf club head of claim 5 wherein one or more of the first horizontal center of gravity, the first vertical center of gravity and the first Z-axis center of gravity of the first removable weight plate is determined based at least in part on information related to swing speed and angle of approach of a swing of the golfer who is to use the golf club head.

8. The reconfigurable golf club head of claim 1 wherein an optimal configuration for the first removable face plate is determined based at least in part on information related to golf club swing characteristics of a golfer who is to use the golf club head.

9. The reconfigurable golf club head of claim 8 wherein one or more of the first loft angle, first bulge radius and first roll radius of the first removable face plate is determined based at least in part on information related to golf club swing characteristics of the golfer who is to use the golf club head.

10. The reconfigurable golf club head of claim 8 wherein one or more of the first loft angle, first bulge radius and first roll radius of the first removable face plate is determined based at least in part on information related to swing speed and angle of approach of a swing of the golfer who is to use the golf club head.

11. The reconfigurable golf club head of claim 1 wherein an optimal configuration for one or more of the first removable weight plate and the first removable face plate is determined based at least in part on golf course conditions affecting ball roll distance.

12. The reconfigurable golf club head of claim 1 wherein an optimal configuration for one or more of the first removable weight plate and the first removable face plate is determined based at least in part on weather conditions expected during a period in which the golf club head is to be used.

13. The reconfigurable golf club head of claim 1 wherein an optimal configuration for one or more of the first removable weight plate and the first removable face plate is determined based at least in part on dynamic flight characteristics of a golf ball with which the golf club head is to be used.

14. The reconfigurable golf club head of claim 1 wherein an optimal configuration for one or more of the first removable weight plate and the first removable face plate is determined based at least in part on rotational inertia of a golf ball with which the golf club head is to be used.

15. The reconfigurable golf club head of claim 1 wherein an optimal configuration for one or more of the first removable weight plate and the first removable face plate is determined based at least in part on lift and drag properties of a golf ball with which the golf club head is to be used.

16. The reconfigurable golf club head of claim 1 wherein an optimal configuration for one or more of the first removable weight plate and the first removable face plate is determined based at least in part on a computer algorithm that takes into account golf ball trajectory tendency information.

17. The reconfigurable golf club head of claim 1 wherein an optimal configuration for one or more of the first removable weight plate and the first removable face plate is determined based at least in part on information stored in one or more lookup tables accessed by a computer program.

18. The reconfigurable golf club head of claim 1 wherein an optimal configuration for one or more of the first removable weight plate and the first removable face plate is determined based at least in part on a computer program using a golf ball trajectory simulation.

19. A reconfigurable golf club head comprising:

a club head body having a horizontal center of gravity, a vertical center of gravity and a Z-axis center of gravity, the club head body including a cavity defined by a body wall having a facial contour and a back surface;

a lug array comprising a plurality of lugs attached to the club head body;

a first removable face plate having a first loft angle, a first bulge radius and a first roll radius, the first removable face plate having a perimeter contour substantially conforming to the facial contour of the body wall and having at least one face plate mounting hole substantially aligned with at least one of the lugs in the lug array;

dampening material disposed between the first removable face plate and the back surface of the club head body;

a plurality of reinstallable fasteners that pass through the mounting holes of the first removable face plate and attach the first removable face plate to the club head body; and a second removable face plate having a second loft angle, a second bulge radius and a second roll radius, where at least one of the second loft angle, second bulge radius and second roll radius is different from the first loft angle, first bulge radius and first roll radius, where the second removable face plate has a perimeter contour substantially conforming to the facial contour of the body wall and has at least one face plate mounting hole substantially aligned with at least one of the lugs in the lug array;

the plurality of reinstallable fasteners including at least one that passes through the at least one mounting hole in the second removable face plate and attaches the second removable face plate to the club head body, whereby the first removable face plate may be removed from the club head body and replaced with the second removable face plate.

* * * * *